US005417475A

United States Patent [19]

Graham et al.

[11] Patent Number: 5,417,475

[45] Date of Patent: May 23, 1995

[54] TOOL COMPRISED OF A HOLDER BODY AND A HARD INSERT AND METHOD OF USING SAME

[75] Inventors: Alexander B. Graham, Hinkley, England; Jan M. Andersson, Bristol, Va.

[73] Assignee: Sandvik AB, Sandviken, Sweden

[21] Appl. No.: 145,225

[22] Filed: Nov. 3, 1993

Related U.S. Application Data

[63] Continuation-in-part of Ser. No. 932,247, Aug. 19, 1992, abandoned.

[51] Int. Cl.[6] ..... E21B 10/56; E21C 35/183

[52] U.S. Cl. ..... 299/79; 299/86; 175/427

[58] Field of Search ..... 299/79, 86; 175/425, 175/427, 435

[56] References Cited

U.S. PATENT DOCUMENTS

| | | | |
|---|---|---|---|
| 2,941,248 | 6/1960 | Hall . | |
| 3,141,746 | 7/1964 | De Lai . | |
| 3,627,381 | 12/1971 | Krekeler | 299/86 |
| 3,627,387 | 12/1971 | Page et al. . | |
| 3,757,878 | 9/1973 | Wilder et al. . | |
| 3,757,879 | 9/1973 | Wilder et al. . | |
| 4,109,737 | 8/1978 | Bovenkerk . | |
| 4,148,368 | 4/1979 | Evans . | |
| 4,274,840 | 6/1981 | Housman . | |
| 4,478,298 | 10/1984 | Hake et al. . | |
| 4,497,520 | 2/1985 | Ojanen | 299/86 |
| 4,531,595 | 7/1985 | Housman . | |
| 4,592,433 | 6/1986 | Dennis . | |
| 4,593,776 | 6/1986 | Salesky et al. | 175/375 |
| 4,604,106 | 8/1986 | Hall et al. | 51/293 |
| 4,682,987 | 7/1987 | Brady et al. | 51/293 |
| 4,694,918 | 9/1987 | Hall . | |
| 4,702,525 | 10/1987 | Sollami et al. | 299/79 |
| 4,707,384 | 11/1987 | Schachner et al. . | |
| 4,718,505 | 1/1988 | Fuller . | |
| 4,731,296 | 3/1988 | Kikuchi et al. . | |
| 4,743,515 | 5/1988 | Fischer et al. . | |
| 4,751,972 | 6/1988 | Jones et al. . | |
| 4,764,434 | 8/1988 | Aronsson et al. . | |
| 4,766,040 | 8/1988 | Hillert et al. . | |
| 4,784,023 | 11/1988 | Dennis . | |
| 4,811,801 | 3/1989 | Salesky et al. . | |
| 4,819,516 | 4/1989 | Dennis . | |
| 4,820,482 | 4/1989 | Fischer et al. . | |
| 4,843,039 | 6/1989 | Akesson et al. . | |
| 4,858,707 | 8/1989 | Jones et al. . | |
| 4,871,377 | 10/1989 | Frushour . | |
| 4,889,017 | 12/1989 | Fuller et al. . | |
| 4,936,538 | 7/1990 | Larsson et al. | 299/86 |
| 4,944,559 | 7/1990 | Sionnet et al. | 299/86 |
| 4,972,637 | 11/1990 | Dyer . | |
| 5,007,207 | 4/1991 | Phaal . | |
| 5,074,623 | 12/1991 | Hedlund et al. | 299/79 |
| 5,161,627 | 11/1992 | Burkett | 299/79 X |
| 5,161,859 | 11/1992 | Larsson et al. | 299/86 |
| 5,217,081 | 6/1993 | Waldenström et al. | 175/420.2 |

FOREIGN PATENT DOCUMENTS

| | | | |
|---|---|---|---|
| 272418A2 | 6/1988 | European Pat. Off. . | |
| 322214A1 | 6/1989 | European Pat. Off. . | |
| 464012A1 | 1/1992 | European Pat. Off. . | |
| 2801675 | 7/1979 | Germany . | |
| 3005684 | 8/1981 | Germany . | |
| 2442146 | 9/1982 | Germany . | |
| 3510072 | 9/1986 | Germany . | |
| 80/5766 | 9/1980 | South Africa . | |
| 2004315 | 3/1979 | United Kingdom . | |
| 2037223 | 7/1980 | United Kingdom | 299/86 |
| 2138864 | 10/1984 | United Kingdom . | |
| 2146058 | 4/1985 | United Kingdom . | |
| 2211875 | 7/1989 | United Kingdom . | |
| 825992 | 4/1981 | U.S.S.R. . | |
| 899916 | 1/1982 | U.S.S.R. . | |
| 1102936 | 3/1983 | U.S.S.R. . | |
| 1344888 | 1/1986 | U.S.S.R. . | |

*Primary Examiner*—David J. Bagnell

*Attorney, Agent, or Firm*—Burns, Doane, Swecker & Mathis

[57] ABSTRACT

A breaking or excavating tool has a diamond and/or cubic boron nitride coated cutting insert mounted at the forward end of a tool body which is made of a softer material than the insert. A separately formed retaining member such as a washer, ring or sleeve, made of harder material than the body, is brazed to a front face of the body surrounding the insert to protect the tool body against wear.

41 Claims, 2 Drawing Sheets

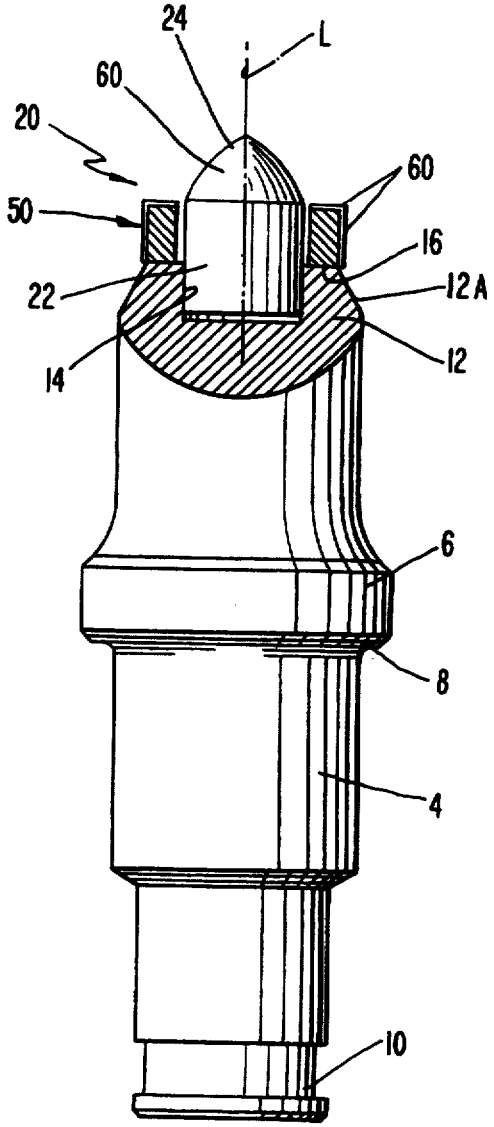
FIG. 4
FIG. 5
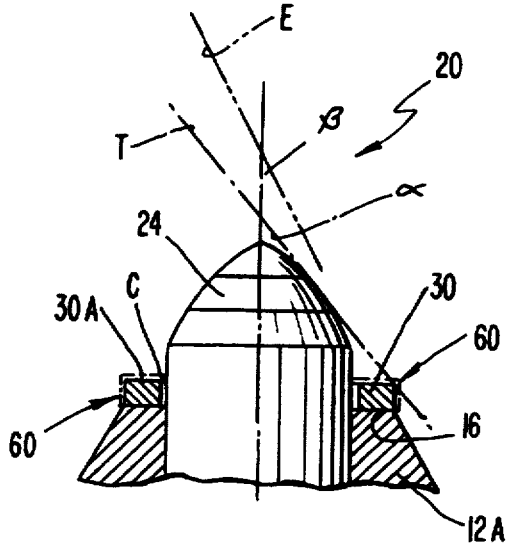
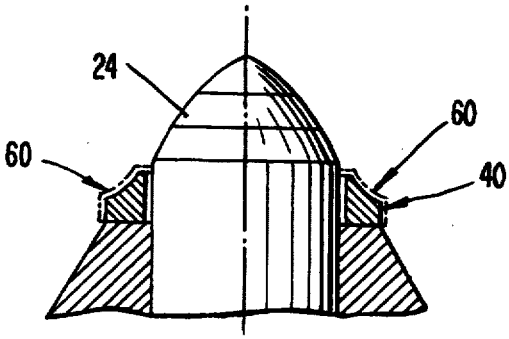
FIG. 6

TOOL COMPRISED OF A HOLDER BODY AND A HARD INSERT AND METHOD OF USING SAME

This application is a continuation-in-part of application Ser. No. 07/932,247 filed Aug. 19, 1992, now abandoned.

FIELD OF THE INVENTION

This invention relates to tools for breaking or excavating, such as for mineral cutting, which comprise a working insert of a harder material projecting from a hole at the tapered front end of a body of the tool, typically of steel.

BACKGROUND OF THE INVENTION

Tools for breaking or excavating with working inserts of hard metal have been produced in configurations (e.g., see European Publication No. 122 893 which corresponds to U.S. Pat. Nos. 4,938,538 and 5,161,859, the disclosures of which are hereby incorporated by reference) which have a lower energy consumption for a given operating capability.

Although the front tip of the insert is intended to provide the cutting or breaking action in these low energy tools, the softer material of the body exposed to impact or abrasion during operation of the tool can suffer wear and damage, one result of which is to weaken the attachment of the insert. The tool then fails prematurely because the insert has been dislodged.

As regards the forms of tool illustrated in European Publication 122 893, this kind of problem is more likely to be encountered when the insert is a simple cylinder with a conical tip. Other insert forms shown in that patent publication have portions much larger than the hole into which the insert fits, so that the outer regions of these conical portions provide protection for the forward end of the body. However, these alternative hard metal inserts are more difficult to produce, because their complex shapes are not well adapted to the pressure sintering method that must be used. They also require substantially more hard metal.

In Soviet Patent 899916 it has been proposed to form the hard metal insert with a large disc-like skirt intermediate its length so that when the cylindrical rear end of the insert is placed in a fitting bore in the front of the tool body the skirt covers the front face around the bore. This requires less material than the large conical portions of the inserts shown in European Publication 122 893, but the shape cannot be formed satisfactorily by sintering, because the very high sintering pressures demanded cannot be applied evenly and the insert will have weaknesses tending to produce premature failure.

German Patent Nos. 24 42 146 and 30 05 684 show tools in which the front portion of the tool body is composed of a matrix containing hard metal. This does not overcome the problem of wear because the softer mass of steel in which the hard metal is held is exposed and although the hard metal particles may not wear they will be dislodged as the steel wears. A greater concentration of hard metal in the matrix to avoid this disadvantage would lead to increased material costs without simplifying the manufacture of the tool.

The tool disclosed in British Patent 2,004,315 has, on the outer circumference of the leading end of its body, a cylindrical ring of hard metal serving as reinforcement for the body, but the metal body between the ring and the insert is still exposed to wear. Furthermore, to the extent that the outer ring functions to protect the tool against abrasion, it is not possible to use this solution to manufacture a so-called low-energy tool because the ring will only have this low energy effect if the entire front end of the tool participates in the cutting or breaking action.

Finally, there may be mentioned examples of tools which can be considered analogous to that in British Patent 2,004,315 in that, instead of the outer ring of hard metal, there is provided a layer of hard metal extending as a complete sheath over at least the forward portion of the shank. One example is to be found in U.S. Pat. No. 4,682,987 in which the hard metal is applied as a fused coating to the shank, clearly a rather complicated and expensive solution. U.S. Pat. No. 3,627,381 shows another example in which a considerably thicker sheath of hard metal is provided, adding to the cost of the tool.

SUMMARY OF THE INVENTION

According to the present invention, there is provided a breaking or excavating tool having improved wear resistance by providing a wear resistant layer such as a diamond and/or cubic boron nitride coating on an exposed surface of a working insert of a tool and/or retaining member such as a ring or sleeve surrounding the insert. The insert has a body portion held in an aperture in the forward end of a body of the tool and a tapered forward tip projecting from the aperture. A separately formed retaining member such as a washer, tapered ring or sleeve surrounds the body portion of the insert and covers a front face of the tool body. The insert and retaining member are secured in position on the tool body and are formed from a harder material than the tool body. The wear resistant coating is formed from a material which is harder than the material forming the insert and/or retaining member and the coating preferably covers all of the tip of the insert and/or all of the exposed surface of the retaining member.

Preferably there is some radial clearance between the retaining member and the insert. One function of such a clearance would be to simplify not only the assembly but also the securing of the retaining member and insert in place. Thus, if they are secured by brazing, it is possible to place the brazing alloy in the tool body aperture, the radial clearance allowing the brazing material from the aperture to flow into contact with the retaining member and simultaneously secure both parts in place.

The retaining member may take a variety of forms. A flat annular shape or cylindrical shape has particular advantages in simplicity of production. For instance, prior to sintering, the individual retaining members can be formed simply by cutting them from an extruded tube of the material. However, it is not necessary for the retaining member to be a closed ring or sleeve and it may be preferred to make up the ring or sleeve from a number of segments, particularly if a form other than the flat annular or the cylindrical form is required.

The insert may also be given a variety of forms, as regards both the exposed cutting tip and the body portion disposed within the main body of the tool. Generally, the cutting tip will have a rotationally symmetrical form but it may be conical or spherical for example. A generally cylindrical form may be most convenient for the body portion but not necessarily of circular cross-section.

The invention also provides a method of breaking or excavating minerals or paving material with a tool comprising a tool body having a forward end; an aperture disposed in said forward end; an insert comprising a body portion received in said aperture and a tapered tip projecting forwardly from said aperture; said insert including a layer of a wear-resistant material which is harder than the insert on an exposed working surface thereof; said forward end including a front face situated adjacent said aperture; a separately formed retaining member lying over said front face and surrounding said body portion of said insert, said insert and retaining member being secured in position on said tool body and being formed from a harder material than said tool body, the method comprising rotating said tool such that the tool extends radially outwardly from an axis of rotation and the forward end of the tool travels in a circular path about the axis of rotation; and moving the tool such that the insert impacts a material to be broken or excavated, whereby the material is broken or excavated by the rotational impact with the insert of the tool.

The invention will be described in more detail by way of example with reference to the accompanying drawing.

BRIEF DESCRIPTION OF THE DRAWINGS

The objects and advantages of the invention will become apparent from the following detailed description of a preferred embodiment thereof in connection with the accompanying drawings in which like numerals designate like elements and in which:

FIG. 4 shows another tool according to the invention in partly sectioned side view;

FIG. 5 shows the tool of FIG. 2 with a wear resistant coating on the flat retaining ring; and FIG. 6 shows the tool of FIG. 3 with a wear resistant coating on the concave surface of the retaining ring.

DETAILED DESCRIPTION OF THE PREFERRED EMBODIMENTS OF THE INVENTION

Figure 1:
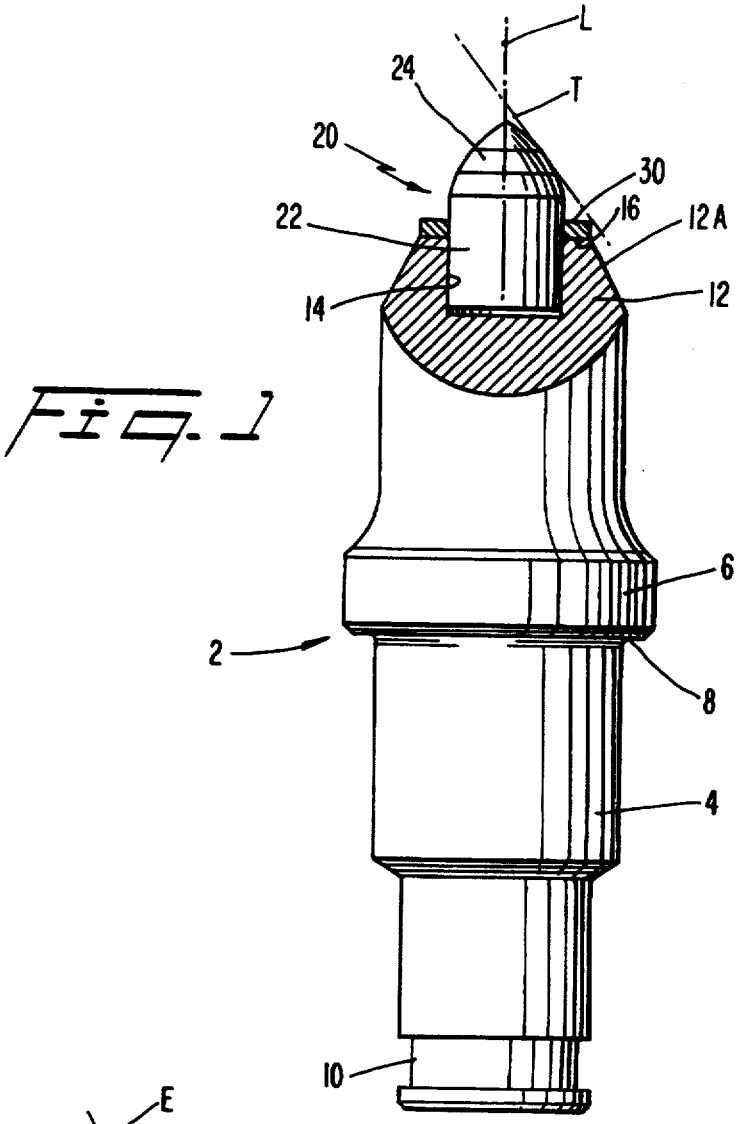
FIG. 1 shows a tool according to the invention in a partly sectioned side view.

The main body 2 of the tool is entirely conventional, being made of steel with a central cylindrical shank 4 which locates the tool rotatably in a bore of a holder (not shown). That is, the tool rotates freely about its longitudinal axis. A shoulder 6 at the forward end of the shank 4 provides an abutment face 8 limiting the insertion of the tool into the bore. A reduced diameter rear portion 10 of the shank serves for mounting a locking ring (not shown) to retain the tool in the bore.

At its forward end the tool body 2 has a tapered front portion 12 in which a central circular bore 14 receives a hard metal cutting insert 20 comprising a main cylindrical portion 22 projecting from the bore and a generally conical tip 24.

As shown in FIGS. 4–6, the insert 20 and/or a retaining member 30, 40, 50 surrounding the insert can include a wear resistant coating 60 of a material harder than the insert 20 or retaining member 30, 40, 50 on an exposed surface thereof. For instance, the insert 20 shown in FIG. 4 can be a cemented carbide and the coating 60 can be diamond and/or cubic boron nitride. The coating 60 can be applied on an exposed surface with or without one or more intermediate non-diamond layers such as Ti, TiC, TiN, etc. therebetween. The coating 60 can be applied by PVD, CVD, high temperature/high temperature (HT/HP) or other conventional technique. The wear resistant coating 60 and intermediate layers can each have a thickness of about 1 to about 100 82 m and the total thickness of the coating 60 can reach 500 μm or more depending on the thickness of each layer and number of layers. For instance, the coating can include several layers of diamond separated by non-diamond layers. U.S. Pat. Nos. 5,154,245 and 4,707,384, the disclosures of which are hereby incorporated by reference, disclose several diamond coating techniques which can be used for applying the coating 60.

The wear resistant coating allows the geometry of the insert to be maintained for a longer time thus reducing the amount of dust created by the tool, reducing the cutting forces, reducing forces acting on the tool, reducing heat created by the cutting action of the tool and reducing the possibility of sparking which could otherwise occur due to the contact between the cemented carbide tool and the material being excavated.

Figure 2:
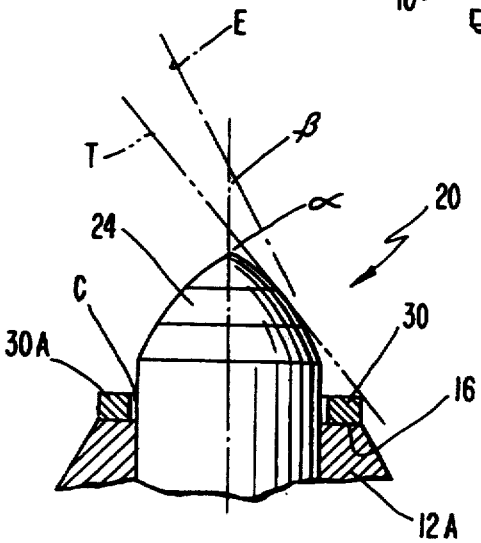
FIG. 2 is an enlarged fragmentary view of FIG. 1.

The tool body has a flat annular face 16 surrounding the bore 14 and that face is covered by a retaining member in the form of a separate hard metal washer or ring 30 of flat rectangular cross-section. Alternatively, the retaining member can have any other desirable shape such as the tapered ring 40 shown in FIG. 3 or the sleeve 50 shown in FIG. 4. In the case of the ring 30, the outer diameter is chosen such that a line T tangential to the tapered tip and the periphery of the ring lies at an angle to the longitudinal axis L of the tool, which angle is greater than the angle $\beta$ formed by the axis L and an extension E of the tapered outer surface 12A of the tool body located immediately behind the ring so that the body lies within the conical envelope defined by the tangential line T. That is, as shown in FIG. 2 the line T intersects each of: (i) the outer periphery of the tapered tip 24, (ii) an outer edge of a forwardly facing surface 30A of the ting, and (iii) the axis L. To avoid premature wear of the ting, however, the angle $\alpha$ is preferably not substantially greater than about 40°. As shown in FIG. 2, there is a small radial clearance C, e.g., not substantially more than 0.5 mm, and preferably not substantially more than 0.2 mm, between insert 20 and ring 30. Similarly, the clearance C can be provided between the tapered ring 40 or the sleeve 50 and the insert 20.

The insert 20 and retaining member 30, 40, 50 are secured to the tool body by brazing. Brazing material (not shown) placed in the bore 14 before assembly of the insert 20 is melted and is able to flow up the sides of the bore and into a first interface between the insert 20 and retaining member 30, 40, 50 and simultaneously into a second interface between the retaining member 30, 40, 50 and body 2. In this way, both parts are brazed simultaneously to the tool body.

In use, the retaining member 30, 40, 50 serves as a simple and economical shield over the most exposed part of the tool body to reduce the wear around the insert and so prolong the life of the tool. By shielding the metal of the body from direct impact with the surface being worked, e.g., in rock cutting, the tool can also reduce the possibility of sparks being generated.

Depending upon the intended use, the retaining member may be given different forms but it is always made as a separate one piece or multi-piece part to be assembled with the insert on the shank. For particular uses the insert and retaining member may be made of other materials, such as cubic boron nitride or polycrystalline diamond, including composites of two or more materials, and the insert and retaining member can be made of different materials from each other to reflect their different functions.

Figure 3:
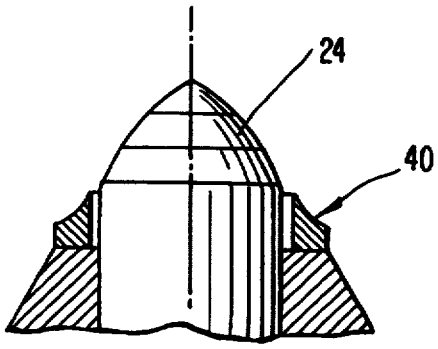
FIG. 3 is a view similar to FIG. 2 depicting an alternate embodiment of a retaining member.

Instead of being flat, the retaining member can be a tapered ring 40 having a concave forward surface as depicted in FIG. 3. Alternatively, the ring 40 can be tapered along the entire length thereof. Likewise, the sleeve 50 can have a uniform wall thickness or the sleeve can be tapered, stepped, etc. along all or part of the length thereof. In the case where the retaining member comprises the sleeve 50, as shown in FIG. 4, the sleeve can have any desired length such as up to 50 mm. The wall thickness of the retaining member between inner and outer peripheries thereof can vary widely such as from 8 to 25 mm. Also, the washer or ring 30 can have a height between opposed surfaces of the ring which does not exceed its wall thickness between the inner and outer peripheries of the ring 30, as shown in FIG. 2. On the other hand, the tapered ring 40 and the sleeve 50 each have a height "h" which exceeds the wall thickness "t" such that h/t ranges from greater than 1 to as much as 5 or more. For instance, the sleeve 50 can have a wall thickness of 10–20 mm and a h/t of at least 2.5–5.

Although the present invention has been described in connection with preferred embodiments thereof, it will be appreciated by those skilled in the art that additions, modifications, substitutions, and deletions not specifically described may be made without departing from the spirit and scope of the invention as defined in the appended claims.

What is claimed is:

1. A tool comprising a tool body having a forward end; an aperture disposed in said forward end; an insert comprising a body portion received in said aperture and a tapered tip projecting forwardly from said aperture; said forward end including a front face situated adjacent said aperture; a separately formed ring lying over said front face and surrounding said body portion of said insert, said insert and ring each being secured in position on said tool body and being formed from a harder material than said tool body, wherein said ring has a flat annular shape.

2. A tool according to claim 1, wherein a radial clearance is formed between said ring and said insert.

3. A tool according to claim 2, wherein said insert and said ring are secured to said tool body by brazing material, some of which lies in said radial clearance.

4. A tool according to claim 2, wherein said clearance is not greater than about 0.5 mm.

5. A tool according to claim 2, wherein said clearance is not greater than about 0.2 mm.

6. A tool according to claim 1, wherein said front face of said tool body receiving said ring has a flat annular form.

7. A tool according to claim 1, wherein a line tangential to both said tapered tip and said ring lies at an angle of inclination to a longitudinal axis of the tool; an outer periphery of said tool body located immediately rearwards of said ring lying at a lesser angle of inclination to said axis than said tangential line.

8. A tool according to claim 1, wherein a first line intersecting each of an outer periphery of said tapered tip, an outer peripheral edge of a forwardly facing surface of said ring, and a longitudinal axis of the tool forms a first angle with said axis; an outer periphery of said tool body located immediately rearwardly of said ring forming a second angle with said axis, said first angle being larger than said second angle.

9. A tool according to claim 1, wherein the material from which said ring is formed is different from the material from which said insert is formed.

10. A tool according to claim 1, wherein said ring is of one-piece construction.

11. A tool according to claim 1, wherein said insert includes a layer of a wear-resistant material which is harder than the insert on an exposed working surface thereof.

12. A tool according to claim 1, wherein said ring includes a layer of a wear-resistant material which is harder than the ring on an exposed surface thereof.

13. A tool comprising a tool body having a forward end; an aperture disposed in said forward end; an insert comprising a body portion received in said aperture and a tapered tip projecting forwardly from said aperture; said forward end including a front face situated adjacent said aperture; a separately formed ring lying over said front face and surrounding said body portion of said insert, said insert and ring each being secured in position on said tool body and being formed from a harder material than said tool body, wherein said ring includes a front surface of concave shape.

14. A tool according to claim 13, wherein a radial clearance is formed between said ring and said insert.

15. A tool according to claim 14, wherein said insert and said ring are secured to said tool body by brazing material, some of which lies in said radial clearance.

16. A tool according to claim 14, wherein said clearance is not greater than about 0.5 mm.

17. A tool according to claim 14, wherein said clearance is not greater than about 0.2 mm.

18. A tool according to claim 13, wherein said front face of said tool body receiving said ring has a flat annular form.

19. A tool according to claim 13, wherein a line tangential to both said tapered tip and said ring lies at an angle of inclination to a longitudinal axis of the tool; an outer periphery of said tool body located immediately rearwards of said ring lying at a lesser angle of inclination to said axis than said tangential line.

20. A tool according to claim 13, wherein a first line intersecting each of: an outer periphery of said tapered tip, an outer peripheral edge of a forwardly facing surface of said ring, and a longitudinal axis of the tool, forms a first angle with said axis; an outer periphery of said tool body located immediately rearwardly of said ring forming a second angle with said axis, said first angle being larger than said second angle.

21. A tool according to claim 13, wherein the material from which said ring is formed is different from the material from which said insert is formed.

22. A tool according to claim 13, wherein said ring is of one-piece construction.

23. A tool according to claim 13, wherein said insert includes a layer of a wear resistant material which is harder than the insert on an exposed working surface thereof.

24. A tool according to claim 13, wherein said ring includes a layer of a wear resistant material which is harder than the ring on an exposed surface thereof.

25. A tool comprising a tool body having a forward end; an aperture disposed in a front face of said forward end; an insert comprising a body portion received in said aperture and a tapered tip projecting forwardly from said aperture; said front face surrounding said aperture; a separately formed sleeve lying over said front face and surrounding said body portion of said insert, said insert and sleeve being secured in position on said tool body and being formed from a harder material than said tool body.

26. A tool according to claim 25, wherein said sleeve has a height between opposed surfaces of said sleeve which is greater than a wall thickness between inner and outer peripheries of said sleeve.

27. A tool according to claim 25, wherein a radial clearance is formed between said sleeve and said insert.

28. A tool according to claim 27, wherein said insert and said sleeve are secured to said tool body by brazing material, some of which lies in said radial clearance.

29. A tool according to claim 27, wherein said clearance is not greater than about 0.5 mm.

30. A tool according to claim 27, wherein said clearance is not greater than about 0.2 mm.

31. A tool according to claim 25, wherein said sleeve has a height between opposed surfaces of the sleeve which is greater than two and one-half times a wall thickness between inner and outer peripheries of the sleeve.

32. A tool according to claim 25, wherein a line tangential to both said tapered tip and said sleeve lies at an angle of inclination to a longitudinal axis of the tool; an outer periphery of said tool body located immediately rearwards of said sleeve lying at a lesser angle of inclination to said axis than said tangential line.

33. A tool according to claim 25, wherein a first line intersecting each of an outer periphery of said tapered tip, an outer peripheral edge of a forwardly facing surface of said sleeve and a longitudinal axis of the tool forms a first angle with said axis; an outer periphery of said tool body located immediately rearwardly of said sleeve forming a second angle with said axis, said first angle being larger than said second angle.

34. A tool according to claim 25, wherein the material from which said sleeve is formed is different from the material from which said insert is formed.

35. A tool according to claim 25, wherein said sleeve includes a layer of a wear-resistant material which is harder than the sleeve on an exposed surface thereof.

36. A tool according to claim 25, wherein said insert includes a layer of a wear resistant material which is harder than the insert on an exposed working surface thereof.

37. A tool comprising a tool body having a forward end; an aperture disposed in a front face of said forward end; an insert comprising a body portion received in said aperture and a tapered tip projecting forwardly from said aperture; said insert including a layer of wear-resistant material which is harder than the insert on an exposed working surface thereof; said front face surrounding said aperture; a separately formed retaining member lying over said front face and surrounding said body portion of said insert, said insert and retaining member being secured in position on said tool body and being formed from a harder material than said tool body.

38. A tool according to claim 37, wherein the wear resistant material comprises diamond or cubic boron nitride.

39. A tool according to claim 37, wherein the retaining member comprises a sleeve or ring.

40. A tool according to claim 37, wherein said retaining member includes a layer of a wear-resistant material which is harder than the retaining member on an exposed surface thereof.

41. A method of breaking or excavating minerals or paving material with a tool comprising a tool body having a forward end; an aperture disposed in a forward face of said forward end; an insert comprising a body portion received in said aperture and a tapered tip projecting forwardly from said aperture; said insert including a layer of a wear-resistant material which is harder than the insert on an exposed working surface thereof; said front face surrounding said aperture; a separately formed retaining member lying over said front face and surrounding said body portion of said insert, said insert and retaining member being secured in position on said tool body and being formed from a harder material than said tool body, the method comprising rotating said tool such that the tool extends radially outwardly from an axis of rotation and the forward end of the tool travels in a circular path about the axis of rotation; and moving the tool such that the insert impacts a material to be broken or excavated, whereby the material is broken or excavated by the rotational impact with the insert of the tool.

* * * * *